US005403257A

United States Patent [19]

Lehtonen

[11] Patent Number: 5,403,257

[45] Date of Patent: Apr. 4, 1995

[54] MULTI-PULL EXERCISE DEVICES

[75] Inventor: Kari Lehtonen, Paimio, Finland

[73] Assignee: Tunturipyora Oy, Helsinki, Finland

[21] Appl. No.: 101,938

[22] Filed: Aug. 4, 1993

Related U.S. Application Data

[63] Continuation of Ser. No. 831,834, Feb. 6, 1992, abandoned, which is a continuation-in-part of Ser. No. 644,024, Jan. 22, 1991, abandoned.

[30] Foreign Application Priority Data

Feb. 7, 1990 [FI] Finland ..... 900597

[51] Int. Cl.[6] ..... A63B 21/008

[52] U.S. Cl. ..... 482/112; 482/129; 482/130

[58] Field of Search ..... 482/92, 99, 102, 112, 482/113, 121–130

[56] References Cited

U.S. PATENT DOCUMENTS

| | | | |
|---|---|---|---|
| 763,745 | 6/1904 | Frazee et al. | 402/129 |
| 1,561,979 | 11/1925 | Gore . | |
| 3,465,592 | 9/1969 | Perrine . | |
| 3,558,131 | 1/1971 | Dragon . | |
| 3,606,318 | 9/1971 | Gilstrap . | |
| 3,638,941 | 2/1972 | Kulkens . | |
| 3,972,238 | 8/1976 | Thatcher . | |
| 4,326,707 | 4/1982 | Strecker . | |
| 4,480,832 | 11/1984 | Bulmash et al. . | |
| 4,632,388 | 12/1986 | Rockwell . | |
| 4,697,809 | 10/1987 | Rockwell . | |
| 4,728,101 | 3/1988 | King | 482/112 X |
| 4,801,139 | 1/1989 | Vanhoutte et al. | 482/112 |
| 4,828,253 | 5/1989 | Schilketanz . | |
| 4,951,943 | 8/1990 | Farenholtz . | |

FOREIGN PATENT DOCUMENTS

| | | |
|---|---|---|
| 408371 | 6/1979 | Sweden . |
| 2227676 | 8/1980 | United Kingdom . |

*Primary Examiner*—Richard J. Apley
*Assistant Examiner*—John Mulcahy
*Attorney, Agent, or Firm*—Graybeal Jackson Haley & Johnson

[57] ABSTRACT

A multi-pull exercise device comprising a stationary frame, an extensible resistance element carried by the frame, at least two flexible pull lines attached to respective ends of the resistance element; and pulleys guiding the free ends of the pull lines to desired locations of use on the exercise device. To achieve a simple and versatile exercise device, each end of the resistance element is movable axially with respect to the other and with respect to the frame. The resistance mechanism is self-restoring, and can be in the form of a hydraulic or pneumatic cylinder and/or spring.

14 Claims, 4 Drawing Sheets

116
F2
124
126
S
128
F3
S
118
132
110
112
114
S
134
130
S
114
122
120
F1
S 156
152
F2
148
S
144
140
158
S
142

150
146
F1
154
S
152
F2
156
148
S
144
158
S
140
142
154
150
146
F1
S
F2
156
144
148
S
144
140
142

150
146
F1
154
S
152
F2
156
144
148
S
144
158
S
140
142

150
146
F1
154
S

MULTI-PULL EXERCISE DEVICES

CROSS PREFERENCE TO RELATED APPLICATION

This application is a continuation of application Ser. No. 07/831,834, entitled Multi-Pull Exercise Devices, filed Feb. 6, 1992, and now abandoned which is in turn a continuation-in-part of application Ser. No. 07/644,024, entitled Exercise Device, and filed Jan. 22, 1991, now abandoned.

BACKGROUND OF THE INVENTION

1. Field of the Invention

This invention relates to exercise devices comprising a frame, a resistance element fitting on and movable with respect to the frame, at least two flexible pull means attached to the opposite ends of the resistance element; and pulley means for leading the ends of the pull means to desired points of actuation by the user.

2. Description of the Prior Art

Several exercise devices of this general type, sometimes called muscle trainers, are known from the prior art. Devices presently in use employ weights, springs, rubbers, various cylinders, etc. as anchored resistance elements. In present-day so-called pump-operated exercise devices utilizing a resistance element such as a hydraulic or pneumatic cylinder, the cylinder is stationary in use and the resistance force is initiated from a single point, that is, from the end of the piston rod of the cylinder either directly or by means of pulling means such as ropes. The expression "the resistance force is initiated" means here that the pull means are attached to the same part of the resistance element, for instance, at the end of the piston rod, as mentioned above.

A drawback of such prior art devices is that they are complicated and difficult to use. Due to the complicated construction, the operation of these devices is often unsatisfactory; the ropes come off, slacken and become entangled very easily, and need rerouting for various modes of use. In addition, prior art devices are very often heavy and large and noisy in use, as a result of which they are difficult to locate. Exercising on prior art devices is often more or less frustrating as the exchange of ropes takes time away from the exercising activity. Because of their complicated construction, these devices are often very expensive.

SUMMARY OF THE INVENTION

An object and feature of the invention is to provide a device by means of which the disadvantages of prior art exercise devices can be eliminated. This is achieved by providing a multi-pull exercise device which is characterized in that its resistance element is arranged so that it is movable in its operating direction with respect to the stationary frame of the device, i.e. each end of the resistance element is movable relative to the other end and relative to the device's stationary support structure.

An advantage of the invention is that it is easy to use. Its multi-pull features make it possible for several different exercises to be performed on the device without any separate adjustments. This makes the exercising more meaningful as the user loses no time in exchanging or rerouting pull means. Devices of the invention are also reliable in operation as the movements of the resistance element are simple and the pull ropes attached to the movable ends of the resistance element do not slacken, come off or become entangled. Devices according to the invention are light in construction, whereby the support structure is also light and the device is easy to set up, transport and pack. The device is also very silent as it does not comprise any clattering weights; practically speaking, the resistance element, the slide surfaces, and the pull means can be made completely silent. The space requirement of the device of the invention is small as the mechanism itself takes only a little floor space. The device of the invention is versatile in use. An adjustable resistance element can be used, rendering the amount of load in the device steplessly and easily adjustable. The amount of resistance can be optimized in different exercises by using different kinds of pull means transmission layouts to the different points from which the force is derived. Still another advantage of the invention is that it is easy to manufacture because of the small number of parts required and the low cost of manufacture of the parts. Devices according to the invention are also safe, as the resistance mechanism is easy to encase within a vertically or uprightly mounted beam, for example.

These and other features, advantages and characteristics of multi-pull exercise devices according to the present invention will be apparent from .the following, description of various typical embodiments thereof, taken in conjunction with the accompanying drawings.

DESCRIPTION OF THE PREFERRED EMBODIMENTS

Figure 1:
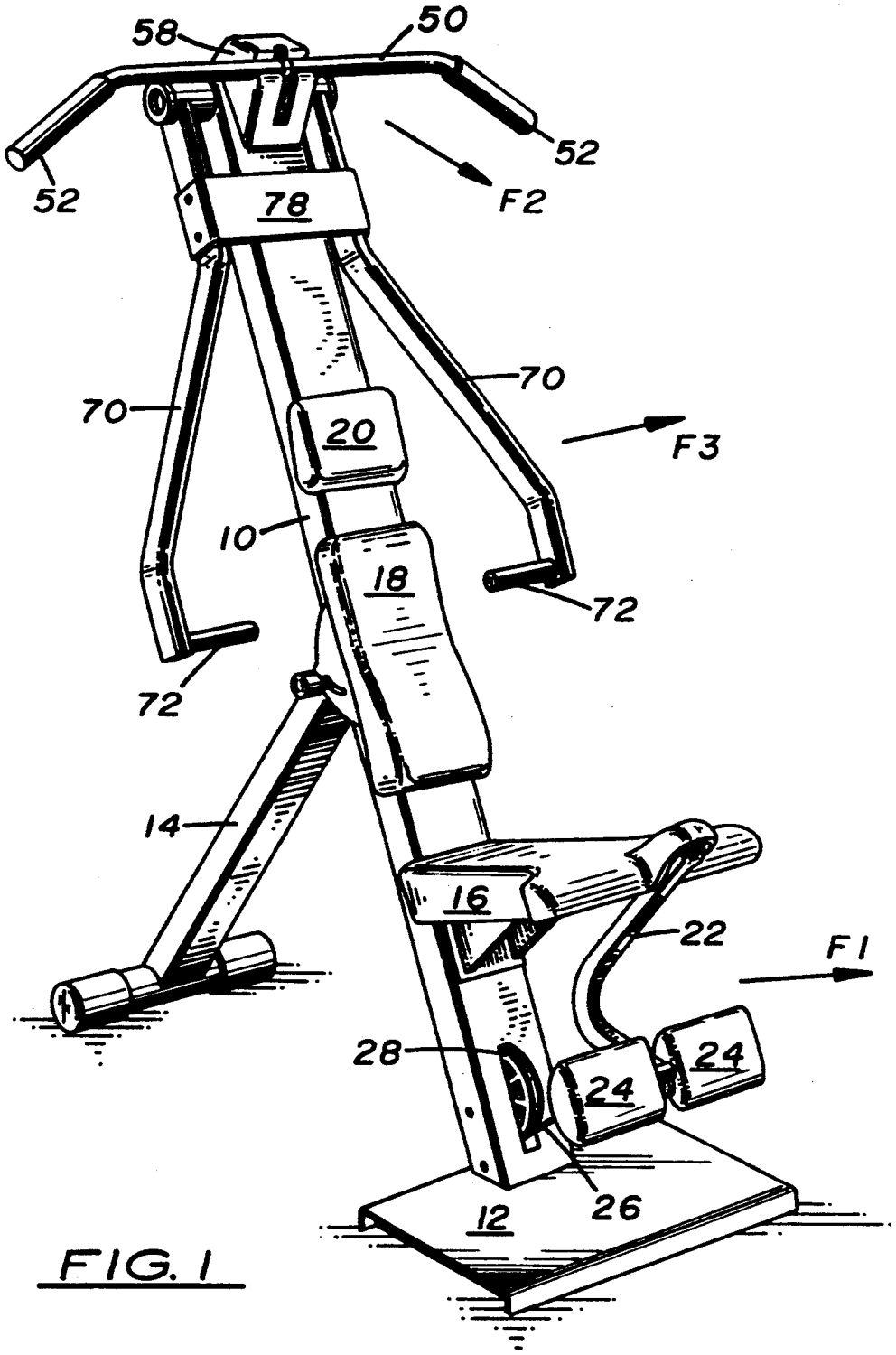
FIG. 1 is an isometric view from a frontal aspect of a typical embodiment of the invention, termable a muscle trainer.
Figure 2:
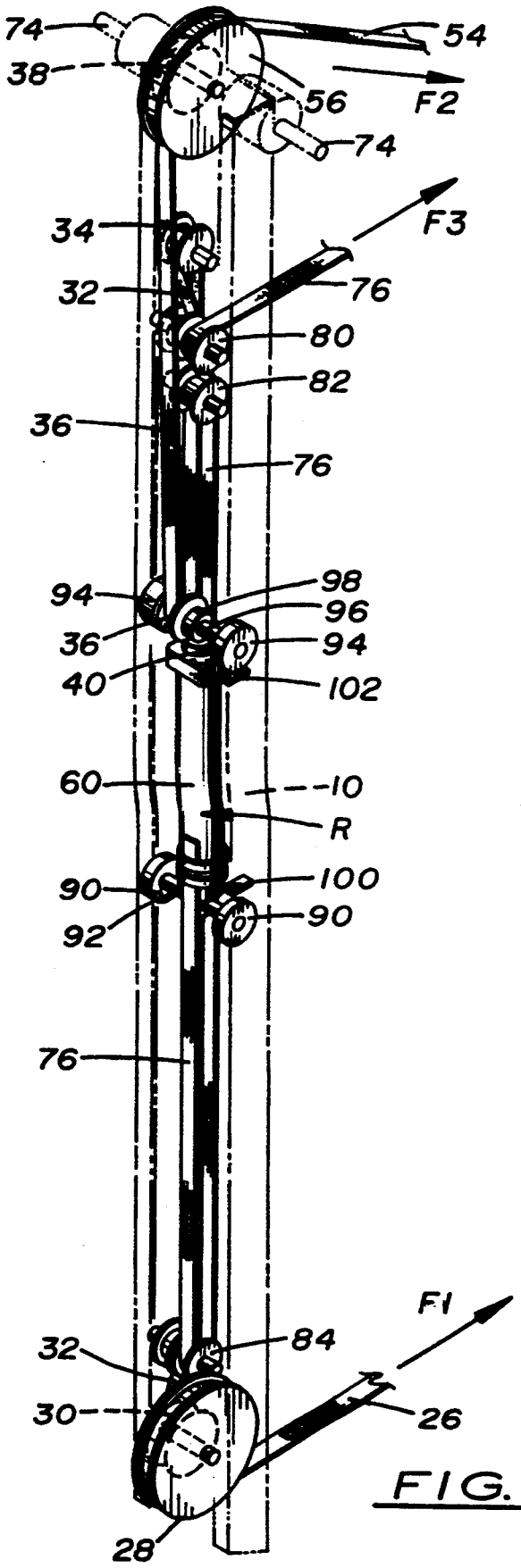
FIG. 2 is an enlarged detail view from a rearward aspect of the resistance mechanism and associated pull components of the exercise device shown in FIG. 1, with the frame beam shown in phantom.

The embodiment of the invention shown in FIGS. 1 and 2 is a muscle trainer designed expressly for exercise of a wide variety of muscle groups. Structurally, as shown in FIG. 1, the device comprises a stationary support structure including a rectangular frame tube or beam 10 uprightly arranged on a base plate 12 and an angularly adjustable rear support leg 14 with a fixed seat 16, a back rest 18, and a neck rest 20 mounted on the frame beam 10. As will be apparent, for exercising the legs of a user seated on seat 16, curved arm 22 pivotally depends from the seat 16 with leg engageable pads 24. Forward movement of the pads 24 and arm 22 by user leg pressure as schematically indicated by arrow F1 is resisted by the connection of arm 22 through pull belt **26*a* wrapped on pulley 28. Ganged with pulley 28 is pulley 30 from which pull belt 32 is led upwardly and around pulley 34 and pulley 36 to pulley 38, the effect of which course of the pull belt 36 is that pull on the belts 26, 32 moves pulley 36 upwardly, said pulley 36 is attached to the piston rod 40** of resistance element R.

In the exerciser shown in FIGS. 1 and 2, pull bar 50 with hand grips 52 is provided which is connected by pull belt 54 to the piston rod 40 portion of resistance element R by way of ganged pulleys 56, 38 and pulley 36 at the top of the piston rod 40. The pulling of pull arm 50 away from its seat 58 (FIG. 1) at the top of frame beam 10, as diagrammatically indicated by the arrow F2 is resisted by extension of the piston rod 40 in the hydraulic cylinder 60 portion of the resistance element R.

As a third exercise mode in the nature of bench pressing with the user seated on seat 16 with his or her back to backrest 18, the exercise device of FIGS. 1 and 2 is provided with pivotally movable arm means 70 with handholds 72. Pivotal movement of the arm 70 forwardly (shown diagrammatically by arrow F3) rotates shafts 74 and extends pull belt 76 (FIG. 2) which is attached to the back of plate 78 spanning the arms 70. The belt 76 is led by way of pulleys 80, 82 and 84 to the attachment thereof to the end of cylinder 60 of resistance mechanism R, and when extended moves the cylinder 60 axially downwardly.

As shown in FIG. 2, axial movement of the cylinder 60 of resistance element R is guided within the channels provided by the C-shaped cross-sectional configuration of the frame beam 10 by laterally spaced rollers 90 journaled on shaft 92 attached to the lower end of the cylinder 60. Similarly, the piston rod 40 portion of the resistance element R is retained in its axial movement within the frame beam 10 by rollers 91 journaled on shaft 96 which is in turn carried by grommet 98 attached to the piston rod 40. As will be apparent, the upwardmost movement of the cylinder 40 portion of the resistance element R is suitably limited by a stop plate or tab 100 and the downwardmost movement of the piston rod 40 is limited by a stop plate or tab 102 on the frame beam 10. The resistance element R is suitably of a conventional form per se with the normal state of rest thereof being with its piston rod portion 40 telescoped to its full extent of movement within the hydraulic cylinder portion 60 and with internal spring biasing to maintain the components in such telescoped condition. Alternatively, external tension spring means (not shown in FIG. 2) can be provided in a manner similar to spring biasing means discussed in the form of the invention later discussed in connection with FIG. 8. Thus, in a manner characteristic of the invention, and with no substantial pull force applied to any of the pull belts 26, 54 and 76 (i.e. by any of pulling forces F1, F2 and F3), the resistance element R is in a state with its component cylinder 60 and component piston rod 40 substantially fully telescoped as shown in FIG. 2. However, by reason of the arrangement shown, either or both of the resistance element components can move axially under the pull of any of the associated belts 26, 54 and 76 with the maximum extent of relative movement of the piston rod and cylinder components of the resistance element R being in one instance with the cylinder portion 60 in its uppermost position and the piston rod 40 in its fully extended uppermost position and in the extreme other instance with the cylinder portion 60 in its lowermost position and with the piston rod portion 40, although fully extended with respect to the cylinder portion, also in its lowermost position. It is a unique feature of this embodiment of the invention that there is increased freedom of relative movement among the actuating arms 22, 50 and 70 of the exercise device, each essentially independently loaded and independently movable with respect to any of the others, all by use of a single resistance element R.

In the form of the invention shown in FIGS. 1 and 2, the various pull means 26, 54 and 76 employed are in the form of flat woven fabric belts, each suitably about one-half inch wide. However, as will be evident, other pull means such as ropes or cords can readily be similarly used.

Figures 3, 4, 5, 6, 7:
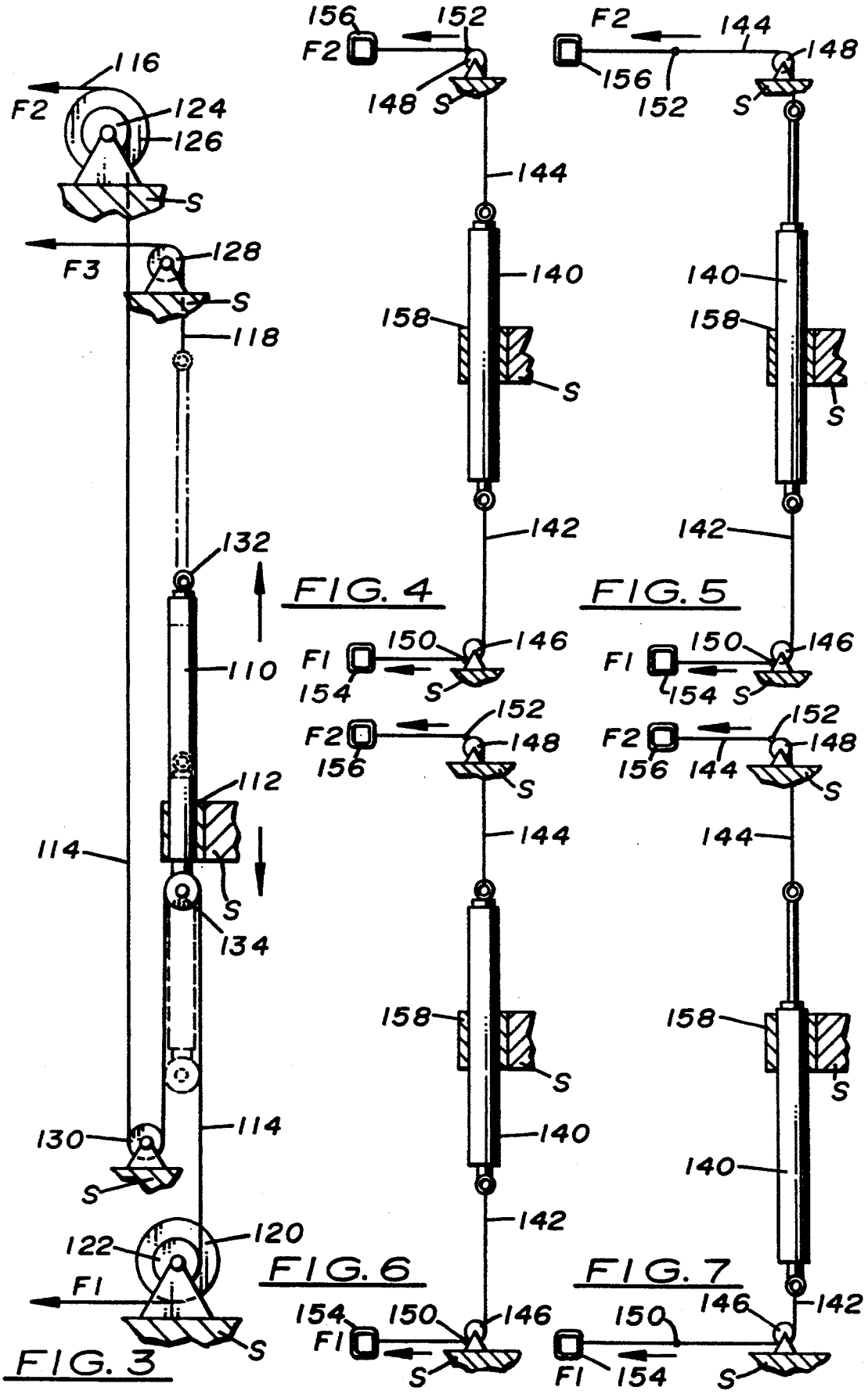
FIG. 3 is a schematic side view of the functional components of a modified form of multi-pull exercise device according to the invention.
FIGS. 4, 5, 6 and 7 schematically illustrate the operation of another embodiment of the invention.

FIG. 3 illustrates schematically a modified embodiment of the invention. Stationary structural portions of an exercise unit embodying this version of the invention can be a frame or beam member such as the beam frame 10 of the earlier discussed embodiment or some other structural portion of the unit which is stationary with respect to a supporting surface such as the floor during use of the unit. In this instance the resistance element 110 is arranged to be movable axially relative to the stationary structure S within a stationary sleeve 112. Reference numerals 114, 116 and 118 indicate flexible pull means and reference numerals 120, 122, 124, 126, 128, 130 and 132 denote pulleys by means of which the flexible pull means 114, 116 and 118 act when pull forces are applied as indicated by the arrows designated F1, F2 and F3.

The basic idea of the invention is to arrange the resistance element 110 to be relatively movable with respect to the structure S and guide sleeve 112 in its operating direction, i.e. axially in both upward and downward directions with the pull means 114 and 118 attached to the respective ends of the resistance element 112. The resistance element 110 is thus describable as movable in its operating direction, and as such expression is used in this context it means that the resistance element 110 is able to move substantially in the direction in which its components relatively extend and contract.

As the resistance element 110 is in this way movable with respect to the support structure S, two force initiation points are provided, i.e. the opposite ends (piston rod on the one hand and cylinder on the other) of the resistance element 110. In this context the term "resistance force initiation point" refers to the points of attachment of the flexible pull means to the resistance element 110, i.e. at eye 132 on the piston rod of the resistance element 110 insofar as pull means 118 is concerned, and at pulley 132 attached to the cylinder component of the resistance element 110 insofar as the pull means 114 is concerned.

An exercise device with pull means actuatable as shown in FIG. 3 operates in such a way that the user pulls on a desired pull means (exerting force F1, F2 or F3), with the pull means provided at different points on the device to enable variations in the training of the muscles of the upper body and the arms from a top position (F3), and from the level of the chest (F2), and the legs from a bottom location (F1), for example.

As will be understood, when using exercise devices according to the invention, if an end of the resistance element is not being used or is at rest, it is to be functionally locked in position, i.e. whenever any given one of the points of pull F1, F2 or F3 is pulled, the other pull means is/are to not yield. Such locking can be made automatic by suitably dimensioning the pull means, whereby the unused pull means such as handles (not shown in FIG. 3) work as stoppers. Alternatively, the extent of movement of the pull line actuating means, and the locking thereof in position when not in use, can be provided for simply by the mechanical nature of the construction. Thus, as in the exercise device shown in FIGS. 1 and 2, for example, there is a stop means inherent in the position of pull belt 26 by reason of the mechanical limit in the rearward angular movement of arm 22 against seat 16, a similar inherent stop on pull belt 54 by reason of the nesting of arm 50 in seat 58, and in pull belt 76 by reason of the engagement of the cross piece 78 with the frame beam 10 in its at rest position.

Of particular note with respect to the resistance element and pull means arrangement illustrated in FIG. 3, and also employed in the embodiment of the invention illustrated in FIGS. 1 and 2, is the use of pulley block mechanism comprised of pulleys 120 and 122 in FIG. 3. Such pulley block mechanism, used in association with movement of the lower end of the resistance element 110, provides a large degree of flexibility as to where the resistance force can be applied to the pull means and also functions to multiply the relatively short movement of the resistance element to a longer movement insofar as concerns the extent of movement of the related pull element. As will be apparent, however, the use of force multiplying power block means is often desirable but not necessary for operation of devices according to the invention.

In the form of the invention schematically illustrated in FIG. 3, the resistance element 110 is axially movable relative to the fixed structure S by means of its mounting in slide sleeve 112. By such arrangement, the resistance element 110 is well supported laterally and can move without substantial friction. A further advantage of this arrangement is that it is simple and requires little service.

In order to clarify the operation of exercise devices according to the invention in their simplest form, FIGS. 4, 5, 6 and 7 show a typical such embodiment schematically, with such form not involving any power block arrangements and only two force initiation points (F1 and F2). FIG. 4 shows the mechanism in its state of rest. Resistance element 140, again a hydraulic cylinder for example, has its cylinder end connected to pull means 142 and its piston rod end connected to pull lines 144, with respective pulleys 146, 148 and line stops 150, 152 and respective pull lines 154, 156 operatively associated with the pull lines 142, 144. As with the arrangement shown in FIG. 3, the embodiment illustrated in FIG. 4 as well as in sequence FIGS. 5, 6 and 7 includes a guide sleeve 158 within which the cylinder component of resistance element 140 is laterally restrained but axially freely movable a limited extent. In FIGS. 4–7, the references F1 and F2 indicate the two force initiation points, F1 being for training the muscles of the legs, for example, and F2 being for the training of the muscles of the upper body, for example.

As will be understood, the resistance element 140 is of a type which is self-restoring in telescoped condition as by inclusion of an internal spring or as by use of external tensioned spring means (not shown), all in a manner conventional per se.

As indicated, the at rest position of the mechanism is shown in FIG. 4. When the user pulls on the resistance element 110, for instance by pulling on pull 156 to apply force F2 in the arrow indicated direction, the result is shown in FIG. 5, i.e. the piston rod extends from the cylinder and the cylinder remains in original position relative to sleeve 158, being held there by line 142 and stop member 150 bearing on pulley 146. As will be apparent, the hand pull 154 could itself act as the stop member if line 146 were shorter.

FIG. 6 illustrates return of the resistance and pull mechanism shown in FIGS. 4 and 5 to the initial at rest position and the application of a force F1 in the arrow indicated direction, which results, as shown in FIG. 7, in the axial movement downwardly of the cylinder end of the resistance element 140 and the relative extension but nonmovement of the piston rod thereof relative to the stationary structure S and sleeve 158. As will be evident, removal of force F1 from the hand pull 54 results in upward axial movement of the cylinder component of resistance element 140 to the point where line stop 150 encounters pulley 146, the at rest condition of the mechanism as illustrated in FIG. 4.

Figure 8:
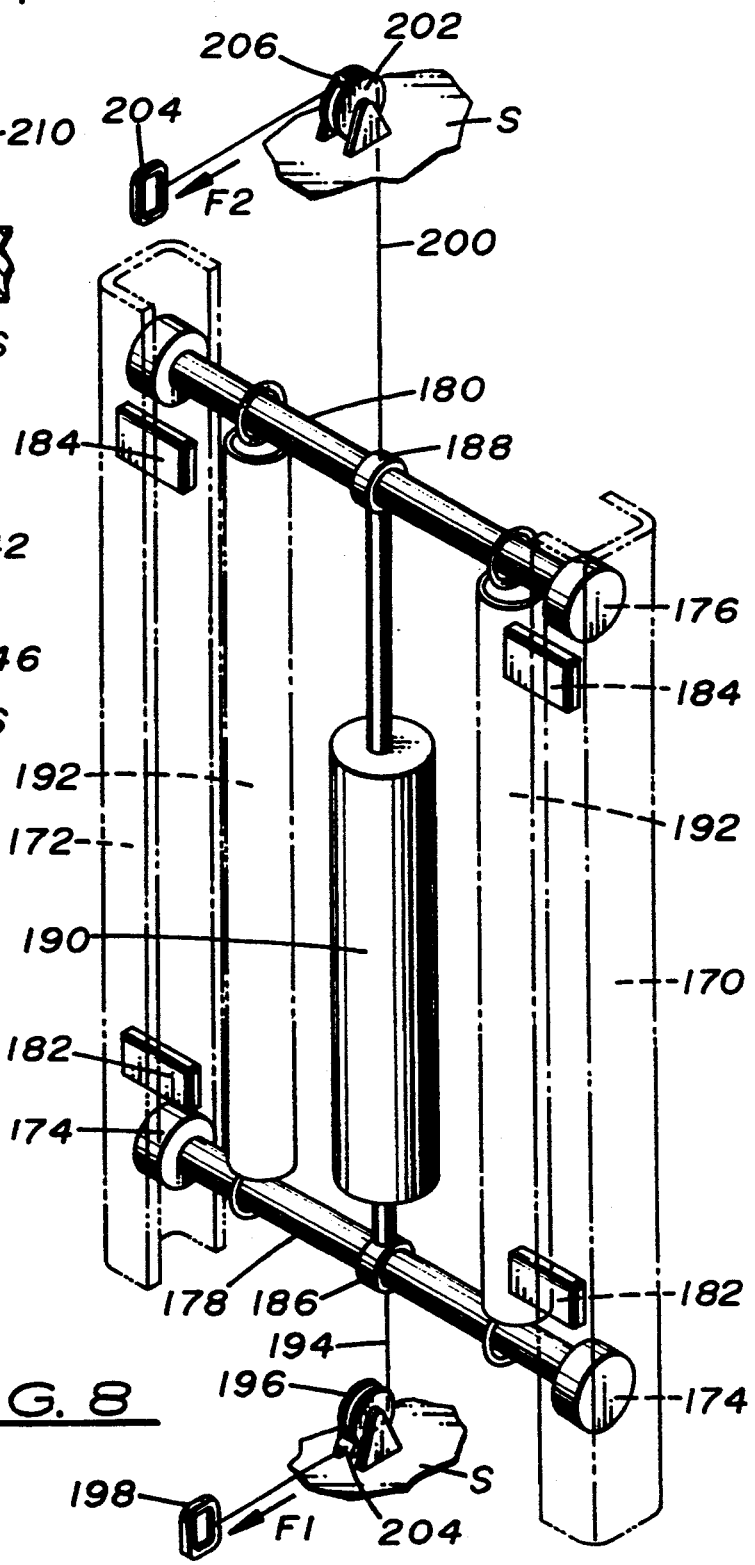
FIG. 8 is an isometic partially schematic illustration of a third embodiment of the invention.

The actual movement of an exercise equipment resistance element as contemplated by the invention can also be effected in ways other than by means of the mounting of the resistance element in a slide sleeve. FIG. 8 shows such an embodiment and, as will be recognized, the schematic showing in FIG. 8 of this embodiment is based on structure very similar to that employed in the embodiment detailed in reference to and shown in FIGS. 1 and 2. In FIG. 8, the equipment frame, not otherwise shown, comprises two more or less upright rails 170, 172 in which respective lower and upper rollers 174, 176 on respective shafts 178, 180 are channeled. Respective lower stops 182 and upper stops 184 limit the extent of movement of the lower rollers 174 in an upward direction and upper rollers 176 limit movement in a downward direction. Eyelet 186 below and eyelet 188 above interconnect the respective cylinder end and piston rod end of resistance element 190 to respective shafts 178, 180. In this arrangement, as shown in FIG. 8, tension springs 192 interconnect the shafts 178, 180 to maintain the resistance element 190 in a relatively telescoped condition when at rest, the mode shown. Lower eyelet 186 and consequently the cylinder end of resistance element 190 has connected thereto pull cord 194 which is wove around pulley 196 on support structure S to pull means 198. Similarly, the upper eyelet 188 on the piston rod of resistance element 190 is connected by pull cord 200 wove around pulley 202 on support structure S to pull means 204. As will be understood, pulling force F1 applied at pull means 198 lowers the cylinder end of resistance element 190 while the piston rod end thereof remains essentially stationary by engagement of wheels 176 with stops 184. Release of force F1 restores the cylinder end of resistance element 190 to its initial position with lower rollers 174 substantially in contact with stope 182. Similarly, application of force F2 to pull means 204 raises eyelet 188 and the connected piston rod of the resistance element 190 with the cylinder end thereof being retained in its original position by reason of the rollers 174 engaging the stops 182 and release of the force F2 causes restoration of the piston rod end of the resistance element 190 and its associated components to their initial position. If desired, further stop means may be used in lieu of or in conjunction with stop means 182, 184 may be utilized on the respective pull lines 186, 200, such as respective line blocks 204, 206.

Figure 9:
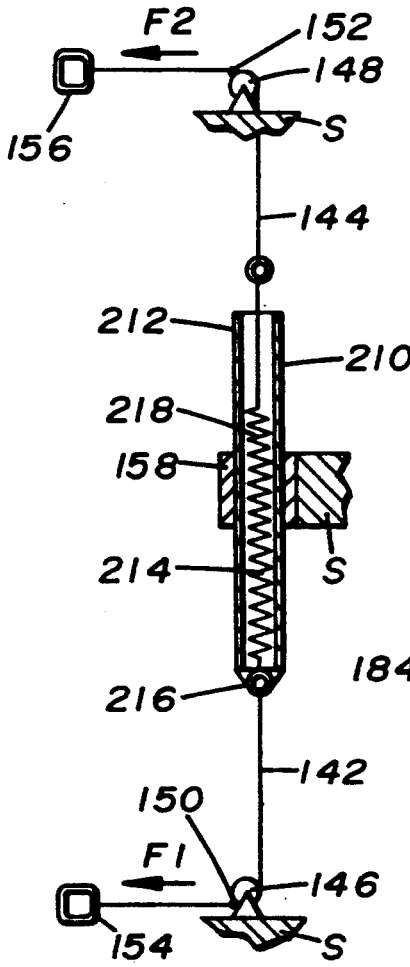
FIG. 9 schematically illustrates a further variant form of the invention.

The further modified embodiment shown in FIG. 9 is similar to that shown in FIGS. 4–7, with respective like parts being indicated with respective like letters and numerals. In this embodiment, however, the resistance element 210 is comprised of a simple cylindrical body 212 with a tension spring 214 arranged coaxially therein and anchored at one end 216 while being free to move axially at the other end 218. As will be evident, operation of this embodiment is similar to that of the embodiment in FIGS. 4–7. Application of force F1 at pull means 154 through pull line 142 pulls cylinder 212 of resistance element 210 downwardly relative to sleeve 158 and supporting surface S while the upper end 218 of spring 214 remains stationary, being there held by pull line 144 which is anchored at stop means 152 against pulley 148. Conversely, with the cylinder 212 of the resistance element 210 held immobile relative to sleeve 158 and supporting surface S by pull line 142 and its stop means 150, application of force F2 at pull means 156 through pull line 144 raises the free end 218 of spring 214 while the cylinder 212 remains in place. In each instance, release of the applied force F1 or F2 causes return of the components to their at rest positions by action of the tension in spring 214.

It is to be understood that the devices of the invention or parts thereof need not necesarily be exactly similar to those shown in the figures or described, but other components and arrangements are possible as well. Thus, for example, the resistance mechanism can be hydraulically or pneumatically loaded, or can be a draw-spring, a rubber spring or any other suitable extensible resilient element. Similarly the pull lines may be of rope, belt or like construction. Different parts can be made of any suitable material, such as metal or plastic. These and other variations will occur to those skilled in the art to which the invention is addressed, within the scope of the following claims.

What is claimed is:

1. An exercise device comprising a frame, an extensible resistance element fitted in the frame and having opposite axially related ends, said opposite ends of said resistance element being movable with respect to each other, at least two flexible pull lines attached to respective ones of said opposite axial ends of said resistance element, and pulleys for guiding said pull lines to desired locations of use on said exercise device, said resistance element including a cylinder at one of said opposite ends and said frame including coupling means restraining movement of said cylinder on said frame laterally of the axial dimension of said cylinder but allowing said cylinder to freely move axially a limited extent with respect to said frame.

2. An exercise device according to claim 1, wherein said resistance element comprises a fluid cylinder.

3. An exercise device according to claim 2, wherein said coupling means comprises a sleeve on said frame, said cylinder being slidably mounted in said sleeve.

4.An exercise device according to claim 2, wherein said coupling means includes shafts and rollers provided at both of said ends of said resistance element, said rollers cooperating with rails in said frame to restrain the movement of said cylinder laterally of the axial dimension of said cylinder.

5. An exercise device according to claim 1, wherein said resistance element comprises a spring member.

6. An exercise device according to claim 5, wherein said coupling means comprises a sleeve on said frame, said cylinder being slidably mounted in said sleeve.

7. An exercise device according to claim 1, wherein said coupling means includes shafts and rollers provided at both of said ends of said resistance element, said rollers cooperating with rails in said frame to restrain the movement of said cylinder laterally of the axial dimension of said cylinder.

8. An exercise device comprising a stationary support structure including a user support for supporting a user, an extensible self-restoring resistance mechanism having opposite axial ends, said opposite ends of said resistance element being freely movable with respect to each other, and including a cylinder body, coupling means coupling said cylinder body to said stationary support structure so as to allow axial movement of said cylinder body, but restraining movement of said resistance mechanism laterally of the axial dimension of said cylinder body during axial movement thereof, plural flexible pull lines in part attached to one of said axial ends of said resistance mechanism and in part attached to the other of said axial ends of said resistance mechanism and including means by which each of said pull lines may be pulled by a user of said exercise device in the course of exercise therewith while being supported by said user support.

9. An exercise device according to claim 8, wherein said coupling means comprises guide rails forming part of said stationary support structure and guide rollers channelled in said guide rails and connected to portions of said resistance mechanism.

10. An exercise device according to claim 8, wherein said resistance mechanism comprises a fluid cylinder with said cylinder body at one of said axial ends thereof and a piston rod at the other of said axial ends thereof and with one said pull line operatively connected to and axially moving said cylinder body relative to said stationary support structure and with another of said pull lines operatively connected to and axially moving said piston rod end relative to said stationary support structure.

11. An exercise device according to claim 10, wherein plural, independently operable pull lines are connected to one of said ends of the said resistance mechanism.

12. An exercise device according to claim 11, wherein plural pull lines are connected to said piston rod end of said resistance mechanism.

13. An exercise device according to claim 8, wherein said coupling means comprises fixed guide rails on said stationary support structure in which move roller means carried by said resistance mechanism.

14. An exercise device according to claim 8, wherein said coupling means comprises a sleeve on said stationary support structure, said cylinder body being slidably mounted in said sleeve.

* * * * *